US009614310B2

(12) United States Patent
Tsai et al.

(10) Patent No.: US 9,614,310 B2
(45) Date of Patent: Apr. 4, 2017

(54) STANDING-TYPE ELECTRICAL RECEPTACLE CONNECTOR

(71) Applicant: ADVANCED-CONNECTEK INC., New Taipei (TW)

(72) Inventors: Yu-Lun Tsai, New Taipei (TW); Pin-Yuan Hou, New Taipei (TW); Chung-Fu Liao, New Taipei (TW); Ya-Fen Kao, New Taipei (TW); Long-Fei Chen, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 15/185,416

(22) Filed: Jun. 17, 2016

(65) Prior Publication Data

US 2016/0372850 A1 Dec. 22, 2016

(30) Foreign Application Priority Data

Jun. 17, 2015 (CN) ..... 2015 1 0336121

(51) Int. Cl.

| | |
|---|---|
| ***H01R 13/648*** | (2006.01) |
| ***H01R 12/72*** | (2011.01) |
| ***H01R 13/405*** | (2006.01) |
| ***H01R 12/70*** | (2011.01) |
| ***H01R 24/60*** | (2011.01) |
| ***H01R 13/6471*** | (2011.01) |
| *H01R 107/00* | (2006.01) |

(52) U.S. Cl.

CPC ..... *H01R 12/724* (2013.01); *H01R 12/707* (2013.01); *H01R 13/405* (2013.01); (Continued)

(58) Field of Classification Search

CPC ..... H01R 13/648; H01R 13/6581; H01R 13/6594; H01R 13/6595; H01R 23/6873; H01R 23/7073; H01R 12/707; H01R 12/724; H01R 13/405; H01R 13/6471; H01R 24/60; H01R 2107/00

(Continued)

(56) References Cited

U.S. PATENT DOCUMENTS 6,109,935 A * 8/2000 Yang ..... H01R 12/725 439/80

6,135,790 A * 10/2000 Huang ..... H01R 13/41 439/607.01

(Continued)

*Primary Examiner* — Tulsidas C Patel

*Assistant Examiner* — Travis Chambers

(74) *Attorney, Agent, or Firm* — Muncy, Geissler, Olds & Lowe, P.C.

(57) ABSTRACT

A standing-type electrical receptacle connector includes a metallic shell, an insulated housing, a plurality of first receptacle terminals, and a plurality of second receptacle terminals. The insulated housing received in the metallic shell is assembled with the first receptacle terminals and the second receptacle terminals. The first receptacle terminals and the second receptacle terminals are respectively held at two sides of the insulated housing along a width direction of the insulated housing, and the length of each of the body portions of the receptacle terminals gradually increases along the width direction of the insulated housing. The tail portions are extending out of the insulated housing and soldered on a circuit board. Accordingly, the standing-type electrical receptacle connector can be assembled to the circuit board in a standing manner.

12 Claims, 8 Drawing Sheets

(52) U.S. Cl.
CPC ..... *H01R 13/6471* (2013.01); *H01R 24/60* (2013.01); *H01R 2107/00* (2013.01)

(58) Field of Classification Search
USPC ..... 439/83, 607.01, 607.04, 607.06, 607.07, 439/607.35–607.4
See application file for complete search history.

(56) References Cited

U.S. PATENT DOCUMENTS 6,309,227 B1 * 10/2001 Chen ..... H01R 12/57 439/607.02
6,371,811 B1 * 4/2002 Chen ..... H01R 13/4361 439/607.37
6,398,587 B1 * 6/2002 Chen ..... H01R 12/7023 439/573
6,419,529 B1 * 7/2002 Shi ..... H01R 25/006 439/607.02
7,748,997 B2 * 7/2010 Hamner ..... H01R 12/712 439/607.01
7,878,827 B2 * 2/2011 Yao ..... H01R 13/665 439/181
8,052,471 B1 * 11/2011 Xiong ..... H01R 12/724 439/607.01
8,475,217 B2 * 7/2013 Zhu ..... H01R 13/506 439/660
8,944,829 B2 * 2/2015 Ho ..... H01R 13/04 439/79
9,281,643 B1 * 3/2016 Tseng ..... H01R 13/518
9,455,532 B2 * 9/2016 Ueda ..... H01R 13/405

* cited by examiner

100

| | | | | | | | | | | | | |
|---|---|---|---|---|---|---|---|---|---|---|---|---|
| GND | TX1+ | TX1- | VBUS | CC1 | D+ | D- | SBU1 | VBUS | RX2- | RX2+ | GND | 31 |
| GND | RX1+ | RX1- | VBUS | SBU2 | D- | D+ | CC2 | VBUS | TX2- | TX2+ | GND | 41 |

Fig. 8

STANDING-TYPE ELECTRICAL RECEPTACLE CONNECTOR

CROSS-REFERENCES TO RELATED APPLICATIONS

This non-provisional application claims priority under 35 U.S.C. §119(a) on Patent Application No. 201510336121.8 filed in China, P.R.C. on 2015 Jun. 17, the entire contents of which are hereby incorporated by reference.

FIELD OF THE INVENTION

The instant disclosure relates to an electrical connector, and more particular to a standing-type electrical receptacle connector.

BACKGROUND

Generally, Universal Serial Bus (USB) is a serial bus standard to the PC architecture with a focus on computer interface, consumer and productivity applications. The existing Universal Serial Bus (USB) interconnects have the attributes of plug-and-play and ease of use by end users. Now, as technology innovation marches forward, new kinds of devices, media formats and large inexpensive storage are converging. They require significantly more bus bandwidth to maintain the interactive experience that users have come to expect. In addition, the demand of a higher performance between the PC and the sophisticated peripheral is increasing. The transmission rate of USB 2.0 is insufficient. As a consequence, faster serial bus interfaces such as USB 3.0, are developed, which may provide a higher transmission rate so as to satisfy the need of a variety devices.

The appearance, the structure, the contact ways of terminals, the number of terminals, the pitches between terminals (the distances between the terminals), and the pin assignment of terminals of a conventional USB type-C electrical connector are totally different from those of a conventional USB electrical connector. A conventional USB type-C electrical receptacle connector includes a plastic core, upper and lower receptacle terminals held on the plastic core, and an outer iron shell circularly enclosing the plastic core. Moreover, the conventional USB type-C electrical receptacle connector is laid on and soldered on a circuit board.

SUMMARY OF THE INVENTION

However, the laid configuration of the conventional USB type-C electrical receptacle connector restricts its usage and application, as well as the mating manner with an electronic device. Because the conventional USB type-C electrical receptacle connector fails to be assembled with an electronic device by a standing manner, the usage and application of the conventional connector is limited. Accordingly, how to improve the existing connector becomes an issue.

In view of this, an embodiment of the instant disclosure provides a standing-type electrical receptacle connector. The standing-type electrical receptacle connector comprises a metallic shell, an insulated housing, a plurality of first receptacle terminals, and a plurality of second receptacle terminals. The metallic shell comprises a shell body and a receptacle cavity formed in the shell body. The insulated housing is received in the receptacle cavity. The insulated housing comprises a base portion, a tongue portion, a first portion, and a second portion. The tongue portion is extending from one of two sides of the base portion. The first portion is connected to the second portion, and the first portion and the second portion are disposed at the other side of the base portion. The tongue portion has a first surface (i.e., upper surface) and a second surface (i.e., lower surface) opposite to the first surface. The first receptacle terminals comprise a plurality of first signal terminals, at least one power terminal, and at least one ground terminal. The first receptacle terminals are held at one of two sides of the insulated housing along a width direction of the insulated housing. Each of the first receptacle terminals comprises a flat contact portion, a body portion, and a tail portion coplanarly disposed at the insulated housing. Each of the body portions comprises a first bending structure disposed at the first portion, and the length of each of the body portions gradually increases along the width direction of the insulated housing. The flat contact portion is extending forward from the body portion in the rear-to-front direction and partly exposed upon the first surface of the tongue portion. The tail portion is extending backward from the body portion in the front-to-rear direction and extending out of the base portion. A first bending portion of each of the first bending structures is directed toward a first direction because of the gradually increased lengths of the body portions of the first receptacle terminals. The second receptacle terminals comprise a plurality of second signal terminals, at least one power terminal, and at least one ground terminal. The second receptacle terminals are held at the other side of the insulated housing along the width direction of the insulated housing. Each of the second receptacle terminals comprises a flat contact portion, a body portion, and a tail portion coplanarly disposed at the insulated housing. Each of the body portions comprises a second bending structure disposed at the second portion, and the length of each of the body portions gradually increases along the width direction of the insulated housing. The flat contact portion is extending forward from the body portion in the rear-to-front direction and partly exposed upon the second surface of the tongue portion. The tail portion is extending backward from the body portion in the front-to-rear direction and extending out of the base portion. A second bending portion of each of the second bending structures is directed toward a second direction because of the gradually increased lengths of the body portions of the second receptacle terminals.

In some embodiments, the first receptacle terminals comprise a plurality of power terminals and a plurality of ground terminals. The first signal terminals comprise a plurality of pairs of first high-speed signal terminals and a pair of first low-speed signal terminals. Each pair of the first high-speed signal terminals is between the corresponding power terminal and the adjacent ground terminal of the first receptacle terminals. Each pair of the first low-speed signal terminals is between two of the power terminals of the first receptacle terminals.

In some embodiments, the second receptacle terminals comprise a plurality of power terminals and a plurality of ground terminals. The second signal terminals comprise a plurality of pairs of second high-speed signal terminals and a pair of second low-speed signal terminals. Each pair of the second high-speed signal terminals is between the corresponding power terminal and the adjacent ground terminal of the second receptacle terminals. Each pair of the second low-speed signal terminals is between two of the power terminals of the second receptacle terminals.

In some embodiments, the portion comprises a first main body and a first fixing block, and the first fixing block is laterally extending from the first main body and engaged with the base portion. The first main body comprises at least one first hollowed groove, the first hollowed groove is defined through the first main body and corresponding to the body portions of the first receptacle terminals.

In some embodiments, the second portion comprises a second main body and a second fixing block, and the second fixing block is laterally extending from the second main body and engaged with the base portion. The second main body comprises at least one second hollowed groove, the second hollowed groove is defined through the second main body and corresponding to the body portions of the second receptacle terminals.

In some embodiments, a surface of the first portion comprises at least one assembling groove, a surface of the second portion comprises at least one assembling block, the assembling block is inserted into the assembling groove to fix the first portion with the second portion.

In some embodiments, the standing-type electrical receptacle connector further comprises a grounding plate at the insulated housing, wherein the grounding plate comprises a plate body and a plurality of hooks, the plate body is between the flat contact portions of the first receptacle terminals and the flat contact portions of the second receptacle terminals, the hooks are extending from two sides of the front of the plate body and protruding out of two sides of the tongue portion.

In some embodiments, the first receptacle terminals and the second receptacle terminals have 180 degree symmetrical design with respect to a central point of the receptacle cavity as the symmetrical center. In addition, the position of the flat contact portions of the first receptacle terminals corresponds to the position of the flat contact portions of the second receptacle terminals.

In some embodiments, the standing-type electrical receptacle connector further comprises a circuit board, wherein the tail portions of the first receptacle terminals and the tail portions of the second receptacle terminals are perpendicular to the circuit board and soldered on the circuit board.

Based on the above, the first receptacle terminals and the second receptacle terminals are respectively held at the two sides of the insulated housing along a width direction of the insulated housing, the length of each of the body portions of the first receptacle terminals gradually increases along the width direction of the insulated housing, and the length of each of the body portions of the second receptacle terminals gradually increases along the width direction of the insulated housing. Moreover, a first bending portion of each of the first bending structures is directed toward a first direction because of the gradually increased lengths of the body portions, and a second bending portion of each of the second bending structures is directed toward a second direction because of the gradually increased lengths of the body portions. Accordingly, the standing-type electrical receptacle connector can be assembled on a circuit board in a standing manner that is different from a conventional connector assembled on a circuit board in a laid manner. Consequently, the standing-type electrical receptacle connector can be assembled to different electronic devices for being approached to different usage requirements. Moreover, the assembling blocks are respectively inserted into the assembling grooves to fix the first portion with the second portion, so that the up-and-bottom movement and the back-and-forth movement of the first portion and those of the second portion are limited. In addition, the first portion and/or the second portion may has hollowed groove for exposing the body portions to air, so that the impedances of the terminals can be changed and adjusted to perform great high frequency characteristics. In addition, the hollowed grooves may be inserted by fixtures to allow the fixtures abutting against the body portions of the receptacle terminals. Accordingly, when the insulated housing is insert-molded with the receptacle terminals, the receptacle terminals are supported by the fixtures, so that the receptacle terminals can be fixed and not moved freely.

Furthermore, the first receptacle terminals and the second receptacle terminals are arranged in a left-right reversal manner, and the pin-assignment of the flat contact portions of the first receptacle terminals is upside down with respect to that of the flat contact portions of the second receptacle terminals. Accordingly, the standing-type electrical receptacle connector can have a 180 degree symmetrical, dual or double orientation design and pin assignments which enables the standing-type electrical receptacle connector to be mated with a corresponding plug connector in either of two intuitive orientations, i.e. in either upside-up or upside-down directions. Therefore, when an electrical plug connector is inserted into the standing-type electrical receptacle connector with a first orientation, the flat contact portions of the first receptacle terminals are in contact with upper-row plug terminals of the electrical plug connector. Conversely, when the electrical plug connector is inserted into the standing-type electrical receptacle connector with a second orientation, the flat contact portions of the second receptacle terminals are in contact with the upper-row plug terminals of the electrical plug connector. Note that, the inserting orientation of the electrical plug connector is not limited by the standing-type electrical receptacle connector of the instant disclosure.

Detailed description of the characteristics and the advantages of the instant disclosure are shown in the following embodiments. The technical content and the implementation of the instant disclosure should be readily apparent to any person skilled in the art from the detailed description, and the purposes and the advantages of the instant disclosure should be readily understood by any person skilled in the art with reference to content, claims and drawings in the instant disclosure.

BRIEF DESCRIPTION OF THE DRAWINGS

The instant disclosure will become more fully understood from the detailed description given herein below for illustration only, and thus not limitative of the instant disclosure, wherein:

FIG. 8 illustrates a schematic configuration diagram of the receptacle terminals of an standing-type electrical receptacle connector according to an embodiment of the instant disclosure.

DETAILED DESCRIPTION

Figure 1:
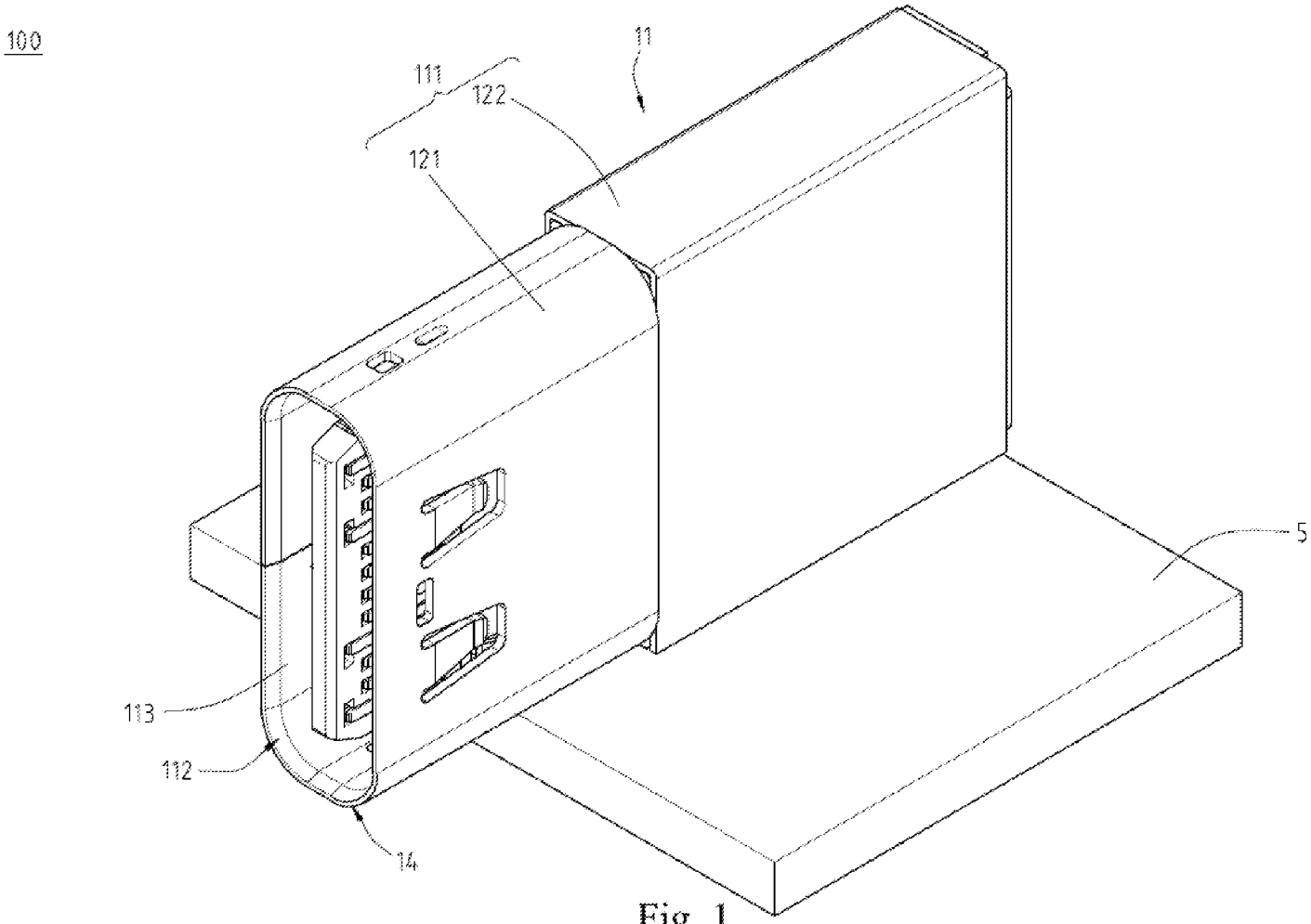
FIG. 1 illustrates a perspective view of an assembly of a circuit board and a standing-type electrical receptacle connector according to an embodiment of the instant disclosure.
Figure 2:
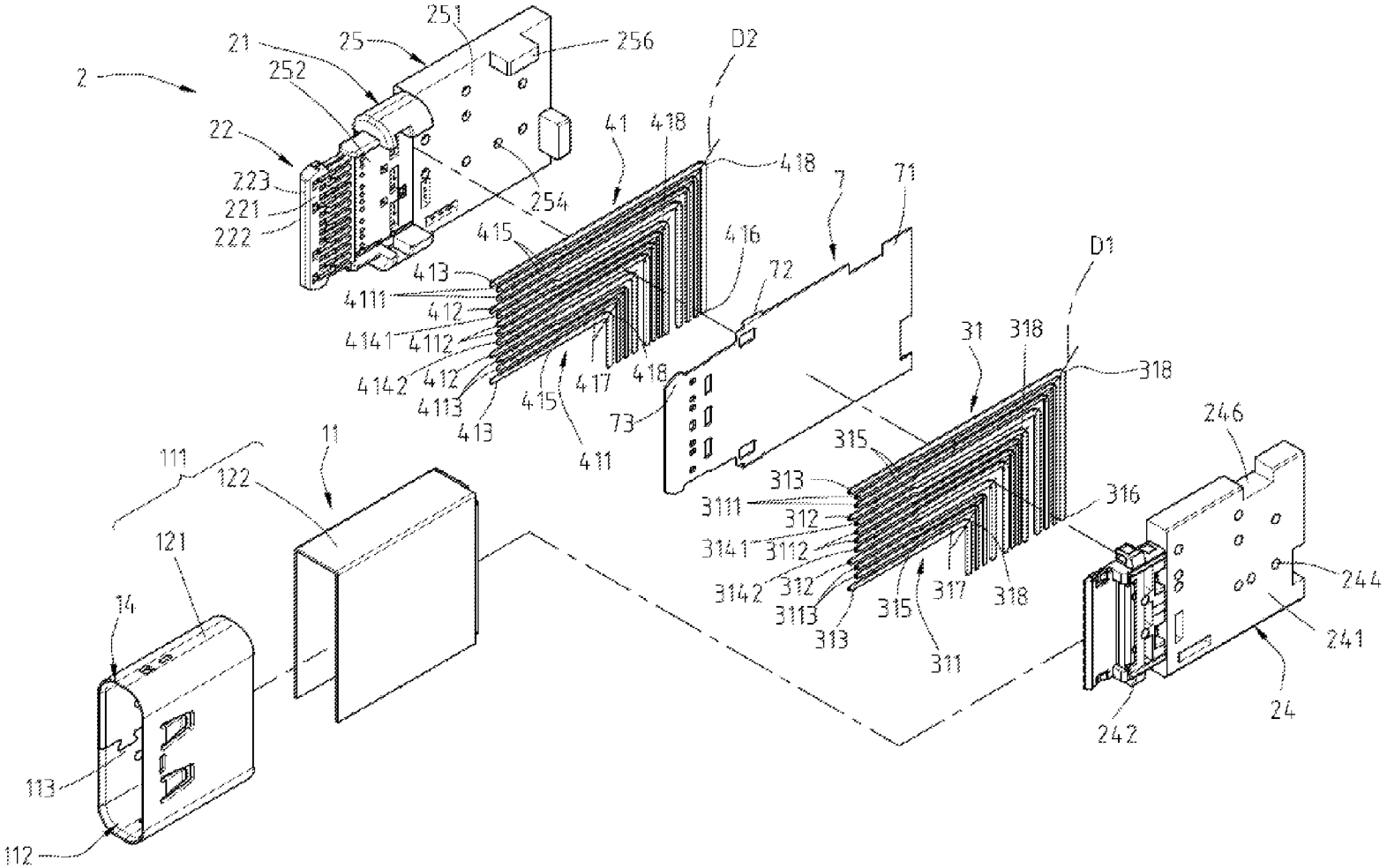
FIG. 2 illustrates an exploded view of a standing-type electrical receptacle connector according to an embodiment of the instant disclosure.
Figure 3:
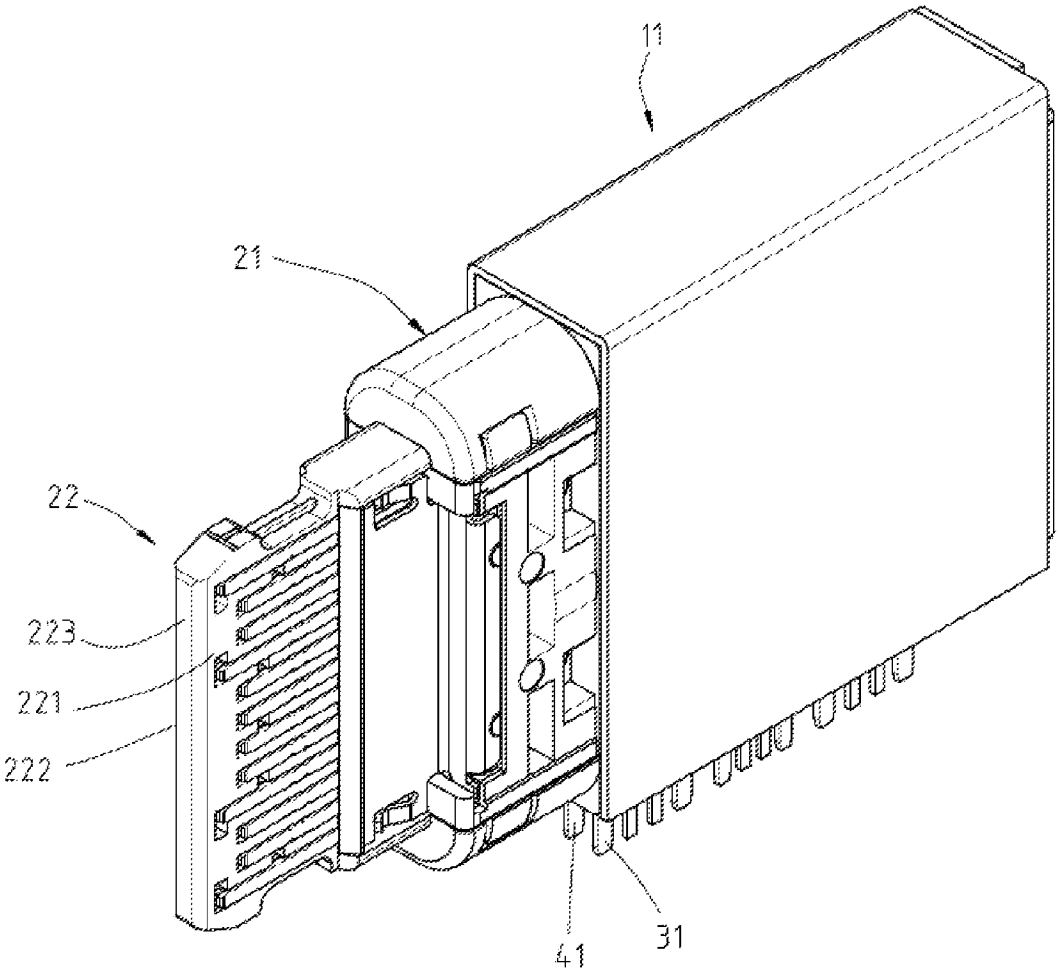
FIG. 3 illustrates a perspective view of a standing-type electrical receptacle connector without a metallic shell, according to an embodiment of the instant disclosure.

Please refer to FIGS. 1 to 3, which illustrate an embodiment of an assembly of a standing-type electrical receptacle connector 100 and a circuit board 5. The standing-type electrical receptacle connector 100 is soldered on the circuit board 5 at a standing manner; that is, one of the narrower sides of the standing-type electrical receptacle connector 100 faces the circuit board 5. FIG. 1 illustrates a perspective view of an assembly of a circuit board 5 and a standing-type electrical receptacle connector 100. FIG. 2 illustrates an exploded view of a standing-type electrical receptacle connector 100. FIG. 3 illustrates a perspective view of a standing-type electrical receptacle connector 100 without a metallic shell 11. In this embodiment, the standing-type electrical receptacle connector 100 can provide a reversible or dual orientation USB Type-C connector interface and pin assignments, i.e., a USB Type-C receptacle connector. In this embodiment, the standing-type electrical receptacle connector 100 comprises a metallic shell 11, an insulated housing 2, a plurality of first receptacle terminals 31, and a plurality of second receptacle terminals 41.

Figure 7:
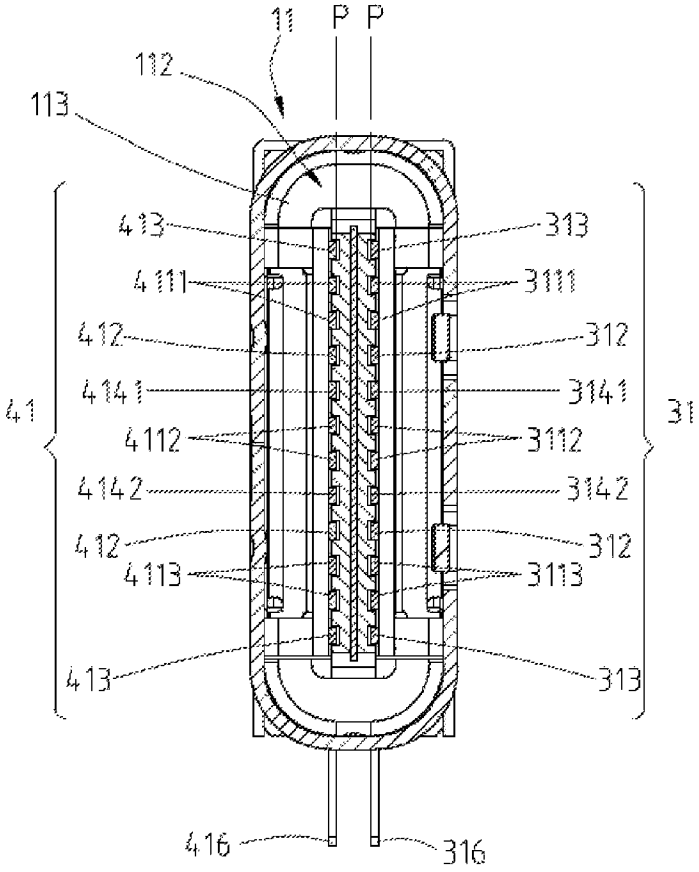
FIG. 7 illustrates a front sectional view (2) of a standing-type electrical receptacle connector according to an embodiment of the instant disclosure.

Please refer to FIGS. 1, 2, and 7. The metallic shell 11 is a hollowed shell, and the metallic shell 11 comprises a shell body 111 and a receptacle cavity 112 formed in the shell body 111. In this embodiment, the shell body 111 is a tubular structure and defines the receptacle cavity 112 therein. While in some embodiments, the metallic shell 11 may be formed by a multi-piece member; in such embodiments, the shell body 111 further comprises an inner shell 121 and a case 122. The inner shell 121 is a tubular structure 14 circularly enclosing the front of the insulated housing 21. The case 122 may have a U-shaped cross section, and the case 122 can be covered on the rear of insulated housing 2. In addition, an inserting opening 113 with oblong shaped is formed at one side of the metallic shell 11, and the inserting opening 113 communicates with the receptacle cavity 112.

Figure 4:
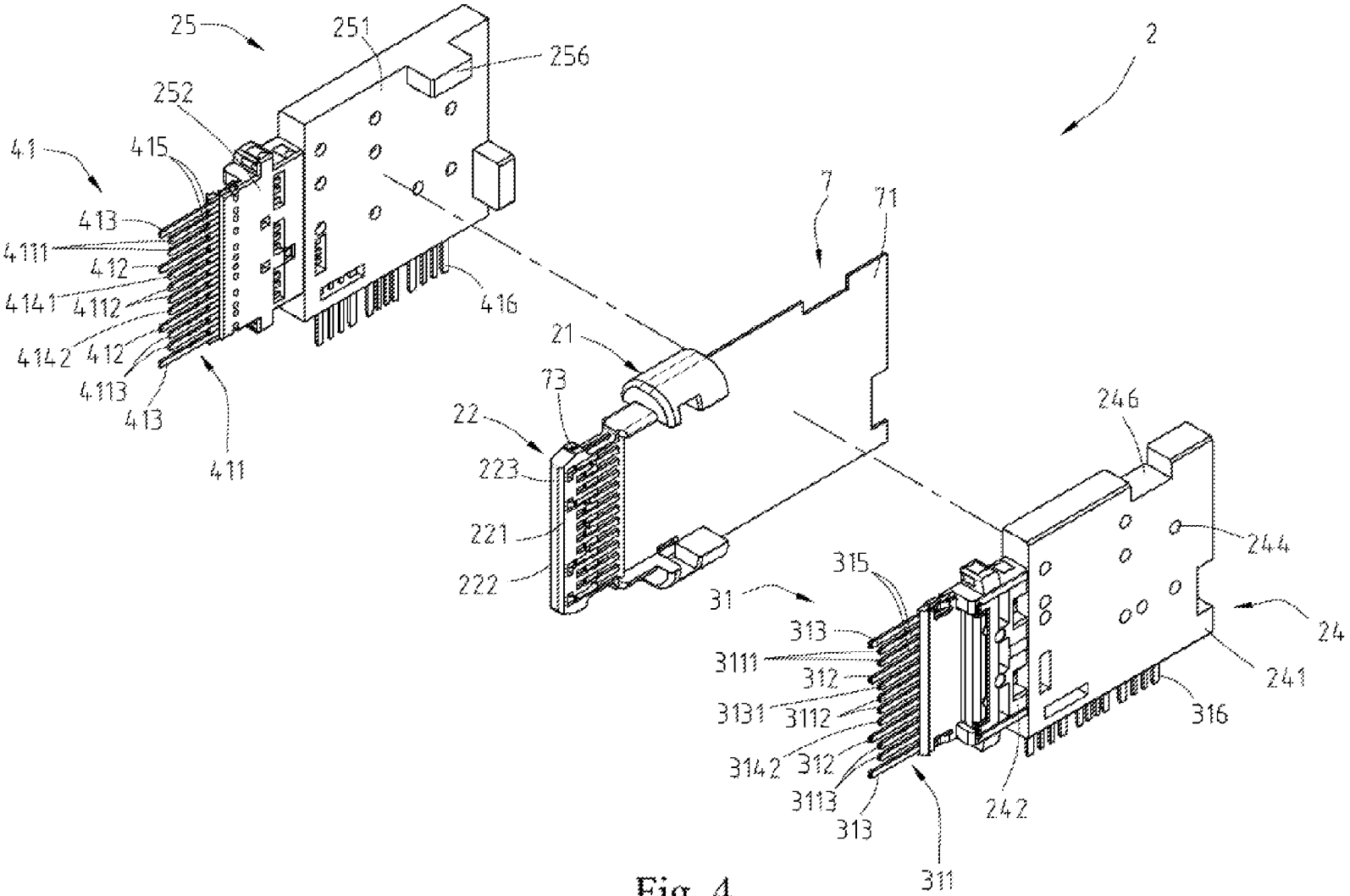
FIG. 4 illustrates a partial exploded view of a standing-type electrical receptacle connector according to an embodiment of the instant disclosure.
Figure 5:
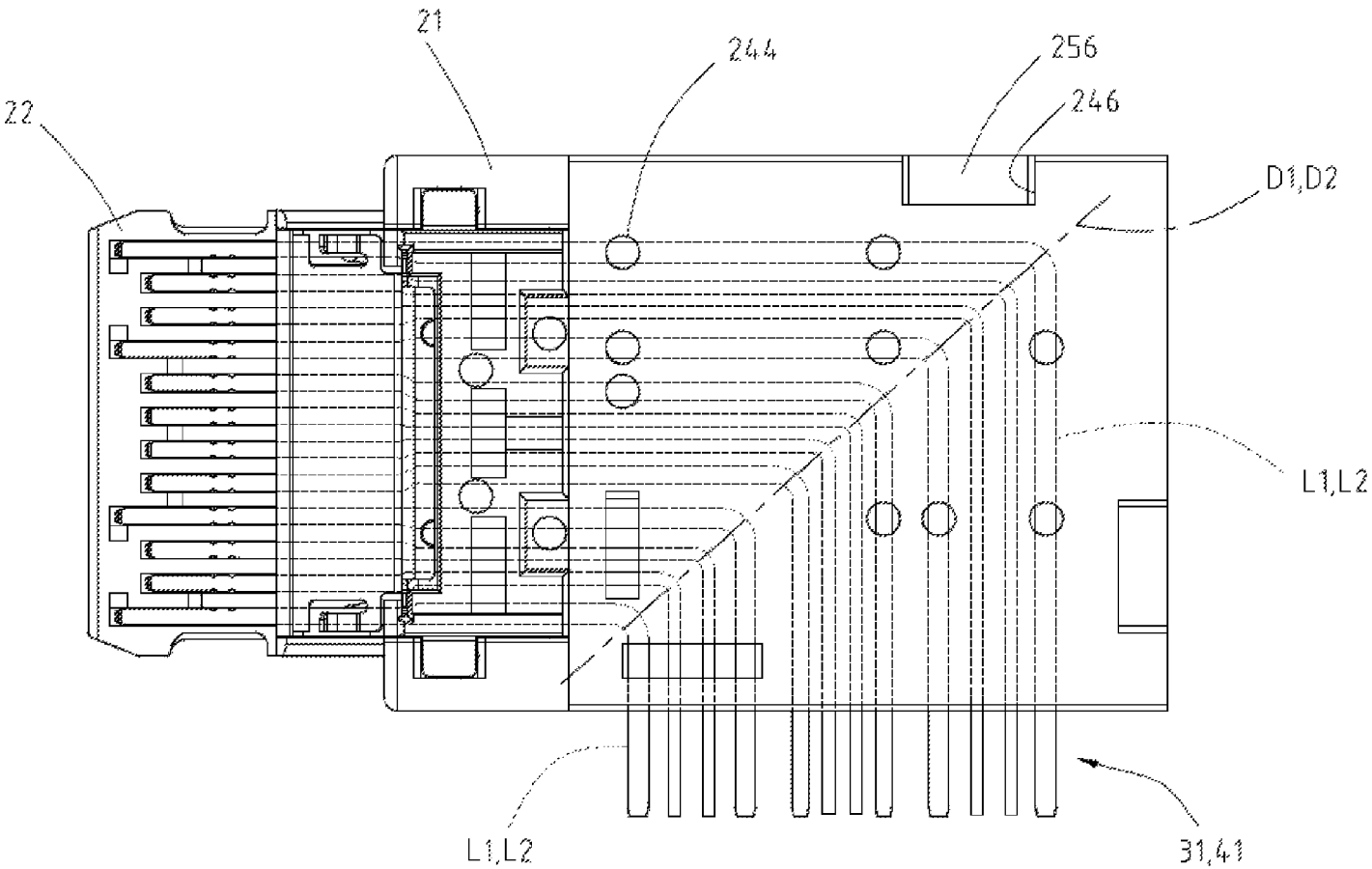
FIG. 5 illustrates a lateral view of a standing-type electrical receptacle connector according to an embodiment of the instant disclosure.

Please refer to FIGS. 2, 4, and 5. The insulated housing 2 is received in the receptacle cavity 112 of the metallic shell 11. The insulated housing 2 comprises a base portion 21, a tongue portion 22, a first portion 24, and a second portion 25. The tongue portion 22 is extending from one of two sides of the base portion 21. The tongue portion 22 is in the front of the interior of the inner shell 121 (i.e., the front of the receptacle cavity 112), while the base portion 21 is in the rear of the interior of the inner shell 121 (i.e., the rear of the receptacle cavity 112). In this embodiment, the base portion 21 and the tongue portion 22 may be made by injection molding or the like to form the insulated housing 2, so that the base portion 21 and the tongue portion 22 are produced integrally as a whole. In addition, a grounding plate 7 is formed in the base portion 21 and the tongue portion 22. In this embodiment, the first portion 24, the second portion 25, and the base portion 21 are combined with each other (i.e., a three-piece member) by assembling means, but embodiments are not limited thereto. In some embodiments, the base portion 21, the first portion 24, and the second portion 25 may be made together by injection molding to form integrally (i.e., to form a one-piece member). Alternatively, the first portion 24 and the second portion 25 may be made together by injection molding followed by assembling with the base portion 21 (i.e., to form a two-piece member). Accordingly, the insulated housing 2 can be assembled rapidly to meet different needs. Moreover, the tongue portion 22 has two opposite surfaces, one is a first surface 221 (i.e., the upper surface), and the other is a second surface 222 (i.e., the lower surface). In addition, the front lateral surface 223 of the tongue portion 22 is connected the first surface 221 with the second surface 222 and is close to the insertion opening 113. In other words, the front lateral surface 223 is adjacent to the insertion opening 113 and perpendicularly connected to the first surface 221 and the second surface 222, respectively.

Please refer to FIGS. 4 and 5. The first portion 24 is connected to the second portion 25, and the first portion 24 and the second portion 25 are disposed at the other side of the base portion 21. In this embodiment, the first portion 24 is assembled to the second portion 25, but embodiments are not limited thereto. The first portion 24 may be combined with the second portion 25 by means of gluing, fusing, and so forth. The first portion 24 comprises a first main body 241 and a first fixing block 242. The first main body 241 is a rectangular shaped plate. The first fixing block 242 is laterally extending from the first main body 241, and the first fixing block 242 can be engaged with the base portion 21. In addition, the second portion 25 comprises a second main body 251 and a second fixing block 252. The second main body 251 is a rectangular shaped plate. The second fixing block 252 is laterally extending from the second main body 251, and the second fixing block 252 can be engaged with the base portion 21.

Please refer to FIGS. 4 and 5. In this embodiment, a surface of the first portion 24 comprises a plurality of assembling grooves 246 (or may be at least one assembling groove 246). The assembling grooves 246 are respectively formed at the rear and the top of the first portion 24. A surface of the second portion 25 comprises a plurality of assembling blocks 256 (or may be at least one assembling block 256). The assembling blocks 256 are respectively formed at the rear and the top of the second portion 25. The assembling blocks 256 are respectively inserted into the assembling grooves 246 to fix the first portion 24 with the second portion 25, so that the up-and-bottom movement and the back-and-forth movement of the first portion 24 and those of the second portion 25 are constrained. The assembling blocks 256 may be combined with the assembling grooves 246 by closely fitting with the assembling grooves 246, or by buckling with the assembling grooves 246.

Please refer to FIGS. 4 and 5. In this embodiment, the first portion 24 comprises a plurality of first hollowed grooves 244 of round and/or rectangular shapes. Each of the round first hollowed grooves 244 corresponds to each of the body portion 317 of the first receptacle terminals 31, while each of the rectangular first hollowed grooves 244 corresponds to several body portions 317 of the first receptacle terminals 31. The first hollowed grooves 244 are defined through different portions of the first portion 24 and correspond to the body portions 317 of the first receptacle terminals 31. In some embodiments, the first portion 24 may comprise at least one first hollowed groove 244 defined therethrough and corresponding to at least one of the body portions 317 of the first receptacle terminals 31. That is, one first hollowed groove 244 may correspond to one or more body portion 317 of the first receptacle terminals 31. In this embodiment, the first hollowed grooves 244 correspond to the body portions 317 of the ground terminal 313, the power terminal 312, and the first signal terminals 311 of the first receptacle terminals 31, respectively. Specifically, the body portions 317 of the ground terminal 313, the power terminal 312, and the first signal terminals 311 of the first receptacle terminals 31 are exposed to air through the first hollowed grooves 244, namely, not covered by the first portion 24. Therefore, the impedance of the two pairs of first high-speed signals 3111/3113 of the first signal terminals 311 may be changed and adjusted to perform great high frequency characteristics. In addition, the first hollowed grooves 244 may be provided for the insertion of fixtures to allow the fixtures abutting against the body portions 317 of the ground terminal 313, the power terminal 312, and the first signal terminals 311 of the first receptacle terminals 31. Accordingly, when the first portion 24 is insert-molded with the first receptacle terminals 31, the body portions 317 of the ground terminal 313, the power terminal 312, and the first signal terminals 311 of the first receptacle terminals 31 are supported by the fixtures, so that the body portions 317 of the ground terminal 313, the power terminal 312, and the first signal terminals 311 of the first receptacle terminals 31 can be fixed and not moved freely even if the first receptacle terminals 31 have extended lengths.

Please refer to FIGS. 4 and 5. In this embodiment, the second portion 25 comprises a plurality of second hollowed grooves 254 of round and/or rectangular shapes. Each of the round second hollowed grooves 254 corresponds to each of the body portion 417 of the second receptacle terminals 41, while each of the rectangular second hollowed grooves 254 corresponds to several body portions 417 of the second receptacle terminals 41. The second hollowed grooves 54 are defined through different portions of the second portion 25 and correspond to the body portions 417 of the second receptacle terminals 41. In some embodiments, the second portion 25 may comprise at least one second hollowed groove 254 defined therethrough and corresponding to at least one of the body portions 417 of the second receptacle terminals 41. That is, one second hollowed groove 254 may correspond to one or more body portion 417 of the second receptacle terminals 41. In this embodiment, the second hollowed grooves 254 correspond to the body portions 417 of the ground terminal 413, the power terminal 412, and the second signal terminals 411 of the second receptacle terminals 41, respectively. Specifically, the body portions 417 of the ground terminal 413, the power terminal 412, and the second signal terminals 411 of the second receptacle terminals 41 are exposed to air through the second hollowed grooves 254, namely, not covered by the second portion 25. Therefore, the impedance of the two pairs of second high-speed signals 4111/4113 of the second signal terminals 411 may be changed and adjusted to perform great high frequency characteristics. In addition, the second hollowed grooves 254 may be provided for the insertion of fixtures to allow the fixtures abutting against the body portions 417 of the ground terminal 413, the power terminal 412, and the second signal terminals 411 of the second receptacle terminals 41. Accordingly, when the second portion 25 is insert-molded with the second receptacle terminals 41, the body portions 417 of the ground terminal 413, the power terminal 412, and the second signal terminals 411 of the second receptacle terminals 41 are supported by the fixtures, so that the body portions 417 of the ground terminal 413, the power terminal 412, and the second signal terminals 411 of the second receptacle terminals 41 can be fixed and not moved freely even if the second receptacle terminals 41 have extended lengths.

Please refer to FIGS. 2, 4, and 5. In this embodiment, the first receptacle terminals 31 may be combined with the first portion 24 by insert-molding; likewise, the second receptacle terminals 41 may also be combined with the second portion 25 by insert-molding. The first portion 24 is combined with the second portion 25. The first receptacle terminals 31 are held at one of two sides of the insulated housing 2 along a width direction of the insulated housing 2 (i.e., the length direction of each of the first receptacle terminals 31 is parallel to the length direction of the insulated housing 2). Likewise, the second receptacle terminals 41 are held at the other side of the insulated housing 2 along the width direction of the insulated housing 2 (i.e., the length direction of each of the second receptacle terminals 41 is parallel to the length direction of the insulated housing 2). In addition, the position of the first receptacle terminals 31 may correspond to the position of the second receptacle terminals 41; alternatively, the position of the first receptacle terminals 31 may be aligned with the position of the second receptacle terminals 41 by an offset.

Please refer to FIGS. 2, 4, 5, and 8. The first receptacle terminals 31 comprise a plurality of first signal terminals 311, at least one power terminal 312, and at least one ground terminal 313. The first signal terminals 31 comprises a plurality of pairs of first high-speed signal terminals 3111/3113 and a pair of first low-speed signal terminals 3112. As viewed from the front of the first receptacle terminals 31 (the pin assignments of the receptacle terminals shown in FIG. 8 correspond to that shown in FIG. 7, when FIG. 8 is viewed from a 90-degree-clockwise view) the first receptacle terminals 31 comprise, from top to bottom, a ground terminal 313 (Gnd), a first pair of first high-speed signal terminals 3111 (TX1+−, differential signal terminals for high-speed signal transmission), a power terminal 312 (Power/VBUS), a first function detection terminal 3141 (CC1, a terminal for inserting orientation detection of the connector and for cable recognition), a pair of first low-speed signal terminals 3112 (D+−, differential signal terminals for low-speed signal transmission), a supplement terminal 3142 (SBU1, a terminal can be reserved for other purposes), another power terminal 312 (Power/VBUS), a second pair of first high-speed signal terminals 3113 (RX2+−, differential signal terminals for high-speed signal transmission), and another ground terminal 313 (Gnd). In this embodiment, twelve first receptacle terminals 31 are provided for transmitting USB 3.0 signals. Each pair of the first high-speed signal terminals 3111/3113 is between the corresponding power terminal 312 and the adjacent ground terminal 313. The pair of the first low-speed signal terminals 3112 is between two of the power terminals 312 of the first receptacle terminals 31. Specifically, the first function detection terminal 3141 and the supplement terminal 3142 are between the two power terminals 312, and the pair of the first low-speed signal terminals 3112 is between the first function detection terminal 3141 and the supplement terminal 3142.

In some embodiments, the topmost ground terminal 313 (Gnd) (or the bottommost ground terminal 313 (Gnd)) or the supplement terminal 3142 (SBU1) can be further omitted. Therefore, the total number of the first receptacle terminals 31 can be reduced from twelve terminals to seven terminals. Furthermore, the topmost ground terminal 313 (Gnd) may be replaced by a power terminal 312 (Power/VBUS) and provided for power transmission. In this embodiment, the width of the power terminal 312 (Power/VBUS) may be, but not limited to, equal to the width of the first signal terminal 311. In some embodiments, the width of the power terminal 312 (Power/VBUS) may be greater than the width of the first signal terminal 311 and an electrical receptacle connector 100 having the power terminal 312 (Power/VBUS) can be provided for large current transmission.

Figure 6:
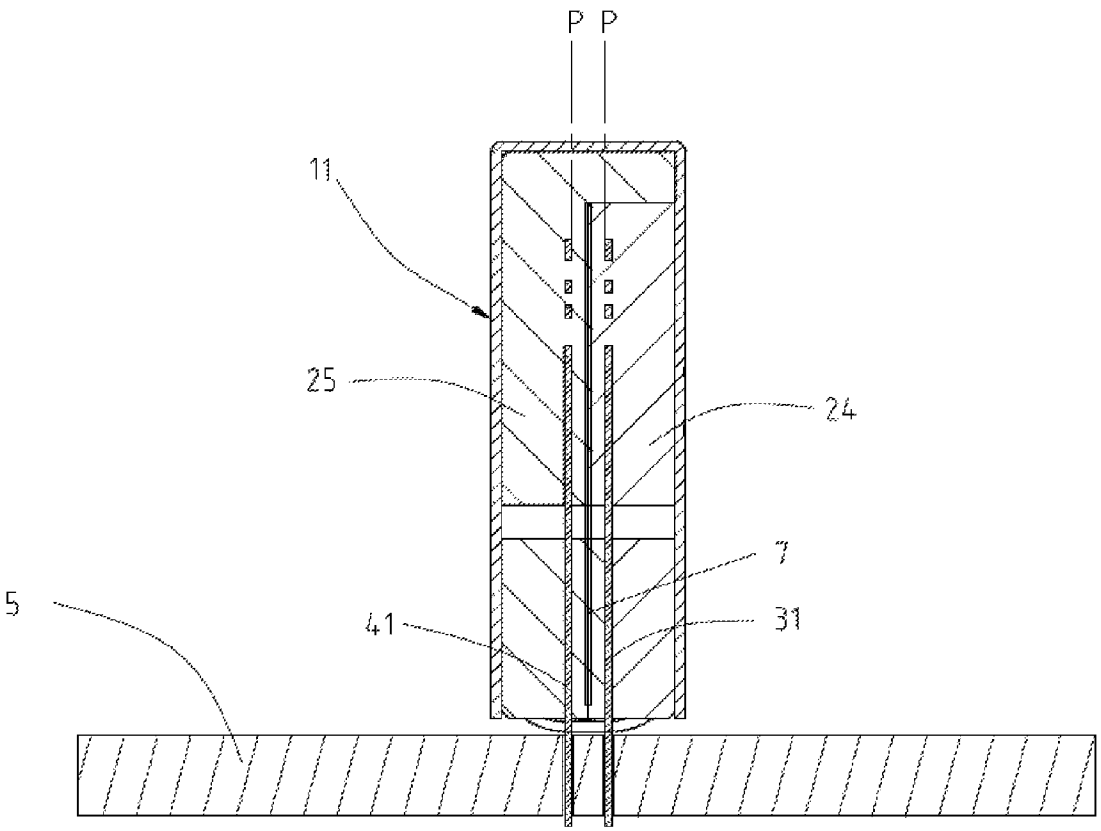
FIG. 6 illustrates a front sectional view (1) of a standing-type electrical receptacle connector according to an embodiment of the instant disclosure.

Please refer to FIGS. 2, 4, and 7. From the front of the connector, the first receptacle terminals 31 are at the right surface of the insulated housing 2 to form the right-row terminals. Each of the first receptacle terminals 31 comprises a flat contact portion 315, a body portion 317, and a tail portion 316 disposed at a coplane P of the insulated housing 2 (as shown in FIG. 6). The flat contact portion 315, the body portion 317, and the tail portion 316 are integrally formed as a whole, and the sidewalls of the flat contact portion 315, the body portion 317, and the tail portion 316 are aligned to the coplane P.

Each of the body portions 317 comprises a first bending structure 318 disposed at the first portion 24. The first bending structure 318 may have a fillet angle or a chamfered angle. One of two ends of the first bending structure 318 is extending toward the flat contact portion 315, and the other end of the first bending structure 318 is extending toward the tail portion 316. The length L1 of each of the body portions 317 gradually increases along the width direction of the insulated housing 2 (in this embodiment, the length L1 of each of the body portions 317 gradually increases, from bottom to top, along the width direction of the insulated housing 2, as shown in FIGS. 2 and 5). In other words, the body portions 317, in reversed and laid L-profiles, are arranged side by side at the insulated housing 2, with lengths L1 thereof being gradually increasing, so that the flat contact portions 315 are approximately at the tongue portion 22 and aligned with each other, and the lengths of the tail portions 316 exposed out of the first portion 24 are approximately the same.

Moreover, the flat contact portion 315 is extending from one of two ends of the body portion 317 and partly exposed upon the first surface 221 of the tongue portion 22, the tail portion 316 is extending from the other end of the body portion 317 and extending out of the first portion 24. In addition, the tail portions 316 are aligned at the first portion 24 along the length direction of the first portion 24. A first bending portion of each of the first bending structures 318 is directed toward a first direction D1 because of the gradually increased lengths L1 of the body portions 317. The first direction D1 is an oblique direction, and the oblique direction is between the horizontal extending direction of the flat contact portion 315 and the vertical extending direction of the tail portion 316. In other words, assumed that the first bending portions of the first bending structures 318 are connected one another, the connection of the first bending portions is aligned with the first direction D1. In this embodiment, each of the flat contact portions 315 is substantially perpendicular to the corresponding tail portion 316, but the angle between each of the flat contact portions 315 and the corresponding tail portion 316 may also be a value from 70 degrees to 110 degrees. And, in the latter embodiment, the flat contact portion 315 may be extending horizontally, while the tail portion 316 may be extending obliquely rather than vertically. In this embodiment, from a side view of the first receptacle terminals 31, the flat contact portion 315, the body portion 317, and the tail portion 316 form a reversed and laid L profile. Accordingly, the tail portions 316 are provided as through-hole legs for inserting into and soldered on the circuit board 5. The first receptacle terminals 31 are held at the tongue portion 22 for transmitting first signal (i.e., USB 3.0 signals).

Please refer to FIGS. 2, 4, 5, and 8. The second receptacle terminals 41 comprise a plurality of second signal terminals 411, at least one power terminal 412, and at least one ground terminal 413. The second signal terminals 41 comprises a plurality of pairs of second high-speed signal terminals 4111/4113 and a pair of second low-speed signal terminals 4112. As viewed from the front of the second receptacle terminals 41 (the pin assignments of the receptacle terminals shown in FIG. 8 correspond to that shown in FIG. 7, when FIG. 8 is viewed from a 90-degree-clockwise view) the second receptacle terminals 41 comprise, from bottom to top, a ground terminal 413 (Gnd), a first pair of second high-speed signal terminals 4111 (TX2+–, differential signal terminals for high-speed signal transmission), a power terminal 412 (Power/VBUS), a second function detection terminal 4141 (CC2, a terminal for inserting orientation detection of the connector and for cable recognition), a pair of second low-speed signal terminals 4112 (D+–, differential signal terminals for low-speed signal transmission), a supplement terminal 4142 (SBU2, a terminal can be reserved for other purposes), another power terminal 412 (Power/VBUS), a second pair of second high-speed signal terminals 4113 (RX1+–, differential signal terminals for high-speed signal transmission), and another ground terminal 413 (Gnd). In this embodiment, twelve second receptacle terminals 41 are provided for transmitting USB 3.0 signals. Each pair of the second high-speed signal terminals 4111/4113 is between the corresponding power terminal 412 and the adjacent ground terminal 413. The pair of the second low-speed signal terminals 4112 is between two of the power terminals 412 of the second receptacle terminals 41. Specifically, the second function detection terminal 4141 and the supplement terminal 4142 are between the two power terminals 412, and the pair of the second low-speed signal terminals 4112 is between the second function detection terminal 4141 and the supplement terminal 4142.

In some embodiments, the topmost ground terminal 413 (Gnd) (or the bottommost ground terminal 413 (Gnd)) or the supplement terminal 4142 (SBU2) can be further omitted. Therefore, the total number of the second receptacle terminals 41 can be reduced from twelve terminals to seven terminals. Furthermore, the topmost ground terminal 413 (Gnd) may be replaced by a power terminal 412 (Power/VBUS) and provided for power transmission. In this embodiment, the width of the power terminal 412 (Power/VBUS) may be, but not limited to, equal to the width of the second signal terminal 411. In some embodiments, the width of the power terminal 412 (Power/VBUS) may be greater than the width of the second signal terminal 411 and an electrical receptacle connector 100 having the power terminal 412 (Power/VBUS) can be provided for large current transmission.

Please refer to FIGS. 2, 4, and 7. From the front of the connector, the second receptacle terminals 41 are at the left surface of the insulated housing 2 to form the left-row terminals. The first receptacle terminals 31 and the second receptacle terminals 41 are aligned side by side correspondingly. Each of the second receptacle terminals 41 comprises a flat contact portion 415, a body portion 417, and a tail portion 416 disposed at a coplane P of the insulated housing 2 (as shown in FIG. 6). The flat contact portion 415, the body portion 417, and the tail portion 416 are integrally formed as a whole, and the sidewalls of the flat contact portion 415, the body portion 417, and the tail portion 416 are aligned to the coplane P.

Each of the body portions 417 comprises a second bending structure 418 disposed at the second portion 25. The second bending structure 418 may have a fillet angle or a chamfered angle. One of two ends of the second bending structure 418 is extending toward the flat contact portion 415, and the other end of the second bending structure 418 is extending toward the tail portion 416. The length L2 of each of the body portions 417 gradually increases along the width direction of the insulated housing 2 (in this embodiment, the length L2 of each of the body portions 417 gradually increases, from bottom to top, along the width direction of the insulated housing 2, as shown in FIGS. 2 and 5). In other words, the body portions 417, in reversed and laid L-profiles, are arranged side by side at the insulated housing 2, with lengths L2 thereof being gradually increasing, so that the flat contact portions 415 are approximately at the tongue portion 22 and aligned with each other, and the lengths of the tail portions 416 exposed out of the second portion 25 are approximately the same.

Moreover, the flat contact portion 415 is extending from one of two ends of the body portion 417 and partly exposed upon the second surface 222 of the tongue portion 22, the tail portion 416 is extending from the other end of the body portion 417 and extending out of the second portion 25. In addition, the tail portions 416 are aligned at the second portion 25 along the length direction of the second portion 25. A second bending portion of each of the second bending structures 418 is directed toward a second direction D2 because of the gradually increased lengths L2 of the body portions 417. The second direction D2 is an oblique direction, and the oblique direction is between the horizontal extending direction of the flat contact portion 415 and the vertical extending direction of the tail portion 416. In other words, assumed that the second bending portions of the second bending structures 418 are connected one another, the connection of the second bending portions is aligned with the second direction D2. In addition, the first direction D1 corresponds to the second direction D2. In this embodiment, each of the flat contact portions 415 is substantially perpendicular to the corresponding tail portion 416, but the angle between each of the flat contact portions 415 and the corresponding tail portion 416 may also be a value from 70 degrees to 110 degrees. And, in the latter embodiment, the flat contact portion 415 may be extending horizontally, while the tail portion 416 may be extending obliquely rather than vertically. In this embodiment, from a side view of the second receptacle terminals 41, the flat contact portion 415, the body portion 417, and the tail portion 416 form a reversed and laid L profile. Accordingly, the tail portions 416 are provided as through-hole legs for inserting into and soldered on the circuit board 5. The second receptacle terminals 41 are held at the tongue portion 22 for transmitting second signal (i.e., USB 3.0 signals).

Please refer to FIGS. 2, 4, and 7. In this embodiment, the first receptacle terminals 31 and the second receptacle terminals 41 are held at the first surface 221 and the second surface 222 of the tongue portion 22, respectively. Specifically, each pair of the second high-speed signal terminals 4111/4113 are spaced from each pair of the first high-speed signal terminals 3111/3113 by a uniform interval. Therefore, the signal interference problem between the first high-speed signal terminals 3111/3113 and the second high-speed signal terminals 4111/4113 can be prevented and improved.

Please refer to FIGS. 2, 4, and 7. Pin-assignments of the first receptacle terminals 31 and the second receptacle terminals 41 are point-symmetrical with a central point of the receptacle cavity 112 as the symmetrical center. In other words, pin-assignments of the first receptacle terminals 31 and the second receptacle terminals 41 have 180 degree symmetrical design with respect to the central point of the receptacle cavity 112 as the symmetrical center. The dual or double orientation design enables an electrical plug connector to be inserted into the standing-type electrical receptacle connector 100 in either of two intuitive orientations, i.e., in either upside-up or upside-down directions. Here, point-symmetry means that after the first receptacle terminals 31 (or the second receptacle terminals 41), are rotated by 180 degrees with the symmetrical center as the rotating center, the first receptacle terminals 31 and the second receptacle terminals 41 are overlapped. That is, the rotated first receptacle terminals 31 are arranged at the position of the original second receptacle terminals 41, and the rotated second receptacle terminals 41 are arranged at the position of the original first receptacle terminals 31. In other words, the first receptacle terminals 31 and the second receptacle terminals 41 are arranged in a left-right reversal manner (the left side of the first receptacle terminals correspond to the right side of the second receptacle terminals, and vise versa), and the pin assignments of the flat contact portions 315 are upside down with respect to that of the flat contact portions 415. An electrical plug connector is inserted into the standing-type electrical receptacle connector 100 with a first orientation where the first surface 221 is facing right, for transmitting first signals. Conversely, the electrical plug connector is inserted into the standing-type electrical receptacle connector 100 with a second orientation where the first surface 221 is facing left, for transmitting second signals. Furthermore, the specification for transmitting the first signals is conformed to the specification for transmitting the second signals. Note that, the inserting orientation of the electrical plug connector is not limited by the standing-type electrical receptacle connector 100 according embodiments of the instant disclosure.

Additionally, in some embodiments, the standing-type electrical receptacle connector 100 is devoid of the first receptacle terminals 31 (or the second receptacle terminals 41) when an electrical plug connector to be mated with the standing-type electrical receptacle connector 100 has upper and lower plug terminals. In the case that the first receptacle terminals 31 are omitted, the upper plug terminals or the lower plug terminals of the electrical plug connector are in contact with the second receptacle terminals 41 of the standing-type electrical receptacle connector 100 when the electrical plug connector is inserted into the standing-type electrical receptacle connector 100 with the dual orientations. Conversely, in the case that the second receptacle terminals 41 are omitted, the upper plug terminals or the lower plug terminals of the electrical plug connector are in contact with the first receptacle terminals 31 of the standing-type electrical receptacle connector 100 when the electrical plug connector is inserted into the standing-type electrical receptacle connector 100 with the dual orientations.

Please refer to FIGS. 4 to 6. In this embodiment, the tail portions 316, 416 are protruding from the base portion 211 and arranged separately. The tail portions 316, 416 may be arranged into three rows. Alternatively, the tail portions 416 of the second receptacle terminals 41 may be aligned into two rows, and the first row of the tail portions 416 is aligned by an offset with respect to the second row of the tail portions 416; thus, the tail portions 316, 416 form three rows.

Please refer to FIGS. 2, 4, and 6. In this embodiment, as viewed from the front of the receptacle terminals 31, 41, the position of the first receptacle terminals 31 corresponds to the position of the second receptacle terminals 41. In other words, the position of the flat contact portions 315 correspond to the position of the flat contact portions 415, but embodiments are not limited thereto. In some embodiments, the first receptacle terminals 31 may be aligned by an offset with respect to the second receptacle terminals 41. That is, the flat contact portions 315 are aligned by an offset with respect to the flat contact portions 415. Accordingly, because of the offset alignment of the receptacle terminals 31, 41, the crosstalk between the first receptacle terminals 31 and the second receptacle terminals 41 can be reduced during signal transmission. It is understood that, when the receptacle terminals 31, 41 of the standing-type electrical receptacle connector 100 have the offset alignment, plug terminals of an electrical plug connector to be mated with the standing-type electrical receptacle connector 100 would also have the offset alignment. Hence, the plug terminals of the electrical plug connector can be in contact with the receptacle terminals 31, 41 of the standing-type electrical receptacle connector 100 for power or signal transmission.

In the foregoing embodiments, the receptacle terminals 31, 41 are provided for transmitting USB 3.0 signals, but embodiments are not limited thereto. In some embodiments, for the first receptacle terminals 31 in accordance with transmission of USB 2.0 signals, the first pair of the first high-speed signal terminals 3111 (TX1+−) and the second pair of the first high-speed signal terminals 3113 (RX2+−) are omitted, and the pair of the first low-speed signal terminals 3112 (D+−) and the power terminals 312 (Power/VBUS) are retained. While for the second receptacle terminals 41 in accordance with transmission of USB 2.0 signals, the first pair of the second high-speed signal terminals 4111 (TX2+−) and the second pair of the second high-speed signal terminals 4113 (RX1+−) are omitted, and the pair of the second low-speed signal terminals 4112 (D+−) and the power terminals 412 (Power/VBUS) are retained.

Please refer to FIGS. 2, 4, 6, and 7. In some embodiments, the standing-type electrical receptacle connector 100 further comprises a grounding plate 7 at the insulated housing 2. The grounding plate 7 comprises a plate body 71, a plurality of legs 72, and a plurality of hooks 73. The plate body 71 is between the flat contact portions 315 of the first receptacle terminals 31 and the flat contact portions 415 of the second receptacle terminals 41, and between the body portions 317 of the first receptacle terminals 31 and the body portions 417 of the second receptacle terminals 41. In other words, the front of the plate body 71 is held in the base portion 21 and the tongue portion 22 and between the flat contact portions 315 and the flat contact portions 415, and the rear of the plate body 71 is held between the first portion 24 and the second portion 25 and between the body portions 317 of the first receptacle terminals 31 and the body portions 417 of the second receptacle terminals 41. In addition, the legs 72 are respectively extending downward from two sides of the plate body 71 and extending out of the bottom of the base portion 21. The legs 72 may be in contact with the metallic shell 11 or contacts of the circuit board 5. Moreover, the legs 72 may be extending backward from the two sides of the plate body 71 toward the rear of the base portion 21. The crosstalk interference can be reduced by the shielding of the grounding plate 7 when the flat contact portions 315, 415 transmit signals. Furthermore, the structural strength of the tongue portion 22 can be improved by the assembly of the grounding plate 7.

Furthermore, the hooks 73 are extending from two sides of the front of the plate body 71 and protruding out of two sides of the tongue portion 22 (as shown in FIG. 4). When an electrical plug connector is mated with the standing-type electrical receptacle connector 100, elastic pieces at two sides of an insulated housing of the electrical plug connector are engaged with the hooks 73, and the elastic pieces would not wear against the tongue portion 22 of the standing-type electrical receptacle connector 100. Additionally, the electrical plug connector may further comprise a plurality of protruding abutting portions, and the protruding abutting portions are in contact with the metallic shell 11 of the standing-type electrical receptacle connector 100. Hence, the elastic pieces and the protruding abutting portions are provided for conduction and grounding.

In this embodiment, the standing-type electrical receptacle connector 100 further comprises a plurality of conductive sheets. The conductive sheets are metal elongated plates and may comprise a right conductive sheet and a left conductive sheet. The left conductive sheet is assembled on the right portion of the base portion 21, and the left conductive sheet is assembled on the left portion of the base portion 21. When an electrical plug connector is mated with the standing-type electrical receptacle connector 100, the front of a metallic shell of the electrical plug connector is in contact with the conductive sheets, the metallic shell of the electrical plug connector is efficiently in contact with the metallic shell 11 of the standing-type electrical receptacle connector 100 via the conductive sheets, and the electromagnetic interference (EMI) problem can be improved.

Based on the above, the first receptacle terminals and the second receptacle terminals are respectively held at the two sides of the insulated housing along a width direction of the insulated housing, the length of each of the body portions of the first receptacle terminals gradually increases along the width direction of the insulated housing, and the length of each of the body portions of the second receptacle terminals gradually increases along the width direction of the insulated housing. Moreover, a first bending portion of each of the first bending structures is directed toward a first direction because of the gradually increased lengths of the body portions, and a second bending portion of each of the second bending structures is directed toward a second direction because of the gradually increased lengths of the body portions. Accordingly, the standing-type electrical receptacle connector can be assembled on a circuit board in a standing manner that is different from a conventional connector assembled on a circuit board in a laid manner. Consequently, the standing-type electrical receptacle connector can be assembled to different electronic devices for being approached to different usage requirements. Moreover, the assembling blocks are respectively inserted into the assembling grooves to fix the first portion with the second portion, so that the up-and-bottom movement and the back-and-forth movement of the first portion and those of the second portion are limited. In addition, the first portion and/or the second portion may has hollowed groove for exposing the body portions to air, so that the impedances of the terminals can be changed and adjusted to perform great high frequency characteristics. In addition, the hollowed grooves may be inserted by fixtures to allow the fixtures abutting against the body portions of the receptacle terminals. Accordingly, when the insulated housing is insert-molded with the receptacle terminals, the receptacle terminals are supported by the fixtures, so that the receptacle terminals can be fixed and not moved freely.

Furthermore, the first receptacle terminals and the second receptacle terminals are arranged in a left-right reversal manner, and the pin-assignment of the flat contact portions of the first receptacle terminals is upside down with respect to that of the flat contact portions of the second receptacle terminals. Accordingly, the standing-type electrical receptacle connector can have a 180 degree symmetrical, dual or double orientation design and pin assignments which enables the standing-type electrical receptacle connector to be mated with a corresponding plug connector in either of two intuitive orientations, i.e. in either upside-up or upside-down directions. Therefore, when an electrical plug connector is inserted into the standing-type electrical receptacle connector with a first orientation, the flat contact portions of the first receptacle terminals are in contact with upper-row plug terminals of the electrical plug connector. Conversely, when the electrical plug connector is inserted into the standing-type electrical receptacle connector with a second orientation, the flat contact portions of the second receptacle terminals are in contact with the upper-row plug terminals of the electrical plug connector. Note that, the inserting orientation of the electrical plug connector is not limited by the standing-type electrical receptacle connector of the instant disclosure.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A standing-type electrical receptacle connector, comprising:

a metallic shell, comprising a shell body and a receptacle cavity defined in the shell body;

an insulated housing received in the receptacle cavity of the metallic shell, wherein the insulated housing comprises a base portion, a tongue portion, a first portion, and a second portion, wherein the tongue portion is extending from one of two sides of the base portion, the first portion is connected to the second portion, and the first portion and the second portion are disposed at the other side of the base portion, and wherein the tongue portion has a first surface and a second surface, and the first surface is opposite to the second surface;

a plurality of first receptacle terminals comprising a plurality of first signal terminals, at least one power terminal, and at least one ground terminal, wherein the first receptacle terminals are held at one of two sides of the insulated housing along a width direction of the insulated housing, wherein each of the first receptacle terminals comprises a flat contact portion, a body portion, and a tail portion coplanarly disposed at the insulated housing, wherein each of the body portions comprises a first bending structure disposed at the first portion, and the length of each of the body portions gradually increases along the width direction of the insulated housing, the flat contact portion is extending from one of two ends of the body portion and partly exposed upon the first surface of the tongue portion, the tail portion is extending from the other end of the body portion and extending out of the first portion, and a first bending portion of each of the first bending structures is directed toward a first direction because of the gradually increased lengths of the body portions; and a plurality of second receptacle terminals comprising a plurality of second signal terminals, at least one power terminal, and at least one ground terminal, wherein the second receptacle terminals are held at the other side of the insulated housing along the width direction of the insulated housing, wherein each of the second receptacle terminals comprises a flat contact portion, a body portion, and a tail portion coplanarly disposed at the insulated housing, wherein each of the body portions comprises a second bending structure disposed at the second portion, and the length of each of the body portions gradually increases along the width direction of the insulated housing, the flat contact portion is extending from one of two ends of the body portion and partly exposed upon the second surface of the tongue portion, the tail portion is extending from the other end of the body portion and extending out of the second portion, and a second bending portion of each of the second bending structures is directed toward a second direction because of the gradually increased lengths of the body portions.

2. The standing-type electrical receptacle connector according to claim 1, wherein the first receptacle terminals comprises a plurality of power terminals and a plurality of ground terminals, wherein the first signal terminals comprise a plurality of pairs of first high-speed signal terminals and a pair of first low-speed signal terminals, each pair of the first high-speed signal terminals is between the corresponding power terminal and the adjacent ground terminal of the first receptacle terminals, the pair of the first low-speed signal terminals is between two of the power terminals of the first receptacle terminals.

3. The standing-type electrical receptacle connector according to claim 1, wherein the second receptacle terminals comprises a plurality of power terminals and a plurality of ground terminals, wherein the second signal terminals comprise a plurality of pairs of second high-speed signal terminals and a pair of second low-speed signal terminals, each pair of the second high-speed signal terminals is between the corresponding power terminal and the adjacent ground terminal of the second receptacle terminals, the pair of the second low-speed signal terminals is between two of the power terminals of the second receptacle terminals.

4. The standing-type electrical receptacle connector according to claim 1, wherein a surface of the first portion comprises at least one assembling groove, a surface of the second portion comprises at least one assembling block, the assembling block is inserted into the assembling groove to fix the first portion with the second portion.

5. The standing-type electrical receptacle connector according to claim 1, further comprising a grounding plate at the insulated housing, wherein the grounding plate comprises a plate body and a plurality of hooks, the plate body is between the flat contact portions of the first receptacle terminals and the flat contact portions of the second receptacle terminals, the hooks are extending from two sides of the front of the plate body and protruding out of two sides of the tongue portion.

6. The standing-type electrical receptacle connector according to claim 1, wherein the first receptacle terminals and the second receptacle terminals have 180 degree symmetrical design with respect to a central point of the receptacle cavity as the symmetrical center.

7. The standing-type electrical receptacle connector according to claim 1, wherein the position of the flat contact portions of the first receptacle terminals corresponds to the position of the flat contact portions of the second receptacle terminals.

8. The standing-type electrical receptacle connector according to claim 1, further comprising a circuit board, wherein the tail portions of the first receptacle terminals and the tail portions of the second receptacle terminals are perpendicular to the circuit board and soldered on the circuit board.

9. The standing-type electrical receptacle connector according to claim 1, wherein the first portion comprises a first main body and a first fixing block, the first fixing block is laterally extending from the first main body and engaged with the base portion.

10. The standing-type electrical receptacle connector according to claim 9, wherein the first main body comprises at least one first hollowed groove, the first hollowed groove is defined through the first main body and corresponding to the body portions of the first receptacle terminals.

11. The standing-type electrical receptacle connector according to claim 1, wherein the second portion comprises a second main body and a second fixing block, the second fixing block is laterally extending from the second main body and engaged with the base portion.

12. The standing-type electrical receptacle connector according to claim 11, wherein the second main body comprises at least one second hollowed groove, the second hollowed groove is defined through the second main body and corresponding to the body portions of the second receptacle terminals.

* * * * *